US009355618B2

(12) United States Patent
Lee et al.

(10) Patent No.: US 9,355,618 B2
(45) Date of Patent: May 31, 2016

(54) TUNING PEG COVERS

(71) Applicant: BOHEMIAN GUITARS L.L.C., Atlanta, GA (US)

(72) Inventors: Adam Lee, Atlanta, GA (US); Shaun Lee, Atlanta, GA (US)

(73) Assignee: Bohemian Guitars Inc., Marietta, GA (US)

( * ) Notice: Subject to any disclaimer, the term of this patent is extended or adjusted under 35 U.S.C. 154(b) by 0 days.

(21) Appl. No.: 14/561,318

(22) Filed: Dec. 5, 2014

(65) Prior Publication Data

US 2015/0161971 A1 Jun. 11, 2015

Related U.S. Application Data

(60) Provisional application No. 61/913,191, filed on Dec. 6, 2013.

(51) Int. Cl.
*G10C 3/10* (2006.01)

(52) U.S. Cl.
CPC ..... *G10C 3/10* (2013.01)

(58) Field of Classification Search
CPC ..... G10D 3/14; G10D 1/005; G10D 1/00; G10D 3/143; G10D 3/00; Y10T 29/49574; Y10T 16/522; G10G 7/02
USPC ..... 84/267, 293, 304, 305
See application file for complete search history.

(56) References Cited

U.S. PATENT DOCUMENTS

| | | | | |
|---|---|---|---|---|
| 5,379,538 | A * | 1/1995 | Osborne | 40/638 |
| 2007/0163420 | A1 * | 7/2007 | Reiss et al. | 84/329 |
| 2013/0247743 | A1 * | 9/2013 | Milone | 84/304 |

* cited by examiner

*Primary Examiner* — Kimberly Lockett
(74) *Attorney, Agent, or Firm* — Eliezer IP, LLC

(57) ABSTRACT

The present disclosure details a tuning peg accessory. The tuning peg accessory may comprise a tuning peg cover. The tuning peg cover may be configured to cover a tuning peg of a stringed instrument. The tuning peg may serve multiple purposes, including, but not limited to, for instrument personalization and learning aid. Still consistent with embodiments of the present disclosure, a tuning peg cover purchase and customization platform may be provided. The platform may enable a user to specify a shape and size of a desired tuning peg cover. Moreover, the platform may enable the user to provide a custom design to be adapted to an exterior surface of the tuning peg cover. Having received the user's specifications, the platform may enable the manufacture, package, and delivery of the customized tuning peg cover.

10 Claims, 5 Drawing Sheets

TUNING PEG COVERS

RELATED APPLICATION

Under provisions of 35 U.S.C. §119(e), the Applicant claims the benefit of U.S. provisional application No. 61/913,191, filed Dec. 6, 2013, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to stringed instrument accessories.

BACKGROUND

Tuning pegs, also known as tuning keys, may be used in tuning instruments, machines, machine heads, tuners, and various other hardware. A tuning peg is used to hold a string in the pegbox of a stringed instrument. Turning the peg tightens or loosens the string, changing the pitch produced when the string is played and thereby tuning it. Tuning pegs may be typically made of for example, ebony, rosewood, boxwood or a metallic material. Some tuning pegs are ornamented with shell, metal, or plastic inlays, beads (pips) or rings.

Tuning pegs are particularly useful in stringed instruments, such as, for example, guitars, ukuleles, banjos, mandolins, violins, violas, cellos, and various bass instruments wherein the tuning pegs are operative to control the tension in the strings of the instrument.

The number of tuning pegs configured on an instrument may depend on a quantity of strings an instrument has. For example, a bass guitar may only have four strings and, thus, comprise four tuning pegs, whereas a guitar may have up to twelve strings with twelve tuning pegs.

Each string instrument may have a unique tuning peg design and configuration. The size and shape of the tuning peg may be directly proportional to the qualities of the string to which the tuning peg is configured. Sometimes, the thickness and length of the string may determine the peg size.

The larger the tuning peg size, the more angular leverage it may provide to a musician in tuning a corresponding string (e.g., increasing or decreasing the string tension with a rotation of the tuning peg). Accordingly, bass guitars may comprise large tuning pegs, whereas violins may be configured with smaller tuning pegs.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

The present disclosure details a tuning peg accessory. The tuning peg accessory may comprise a tuning peg cover. The tuning peg cover may be configured to cover a tuning peg of a stringed instrument. The tuning peg may serve multiple purposes, including, but not limited to, for instrument personalization and learning aid.

Still consistent with embodiments of the present disclosure, a tuning peg cover purchase and customization platform may be provided. The platform may enable a user to specify a shape and size of a desired tuning peg cover. Moreover, the platform may enable the user to provide a custom design to be adapted to an exterior surface of the tuning peg cover. Having received the user's specifications, the platform may enable the manufacture, package, and delivery of the customized tuning peg cover.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1A:
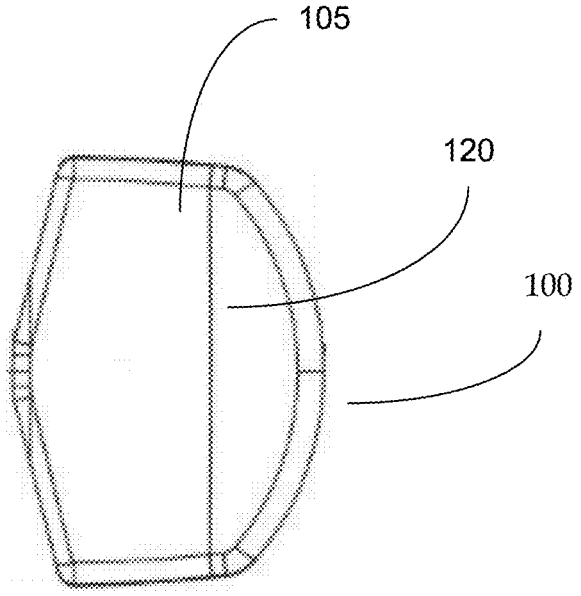
FIG. 1A illustrates a first view of an embodiment of a tuning peg.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

I. Tuning Peg

Figure 1B:
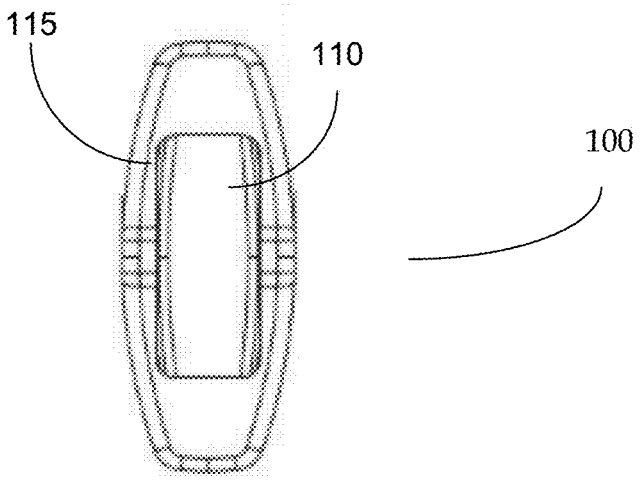
FIG. 1B illustrates a second view of an embodiment of the tuning peg.

Embodiments of the present invention may provide a variety of tuning peg covers. In some embodiments, the tuning peg covers may be known as Headez™. FIGS. 1A-1B illustrate different views of an embodiment of a tuning peg 1. The tuning peg cover may comprise, but not be limited to an interior portion 110 designed to accommodate a tuning peg of a stringed instrument; an exterior shell 105 encompassing interior portion 110; and a slot 115 configured to receive the tuning peg into the interior portion.

Figures 1C, 1D:
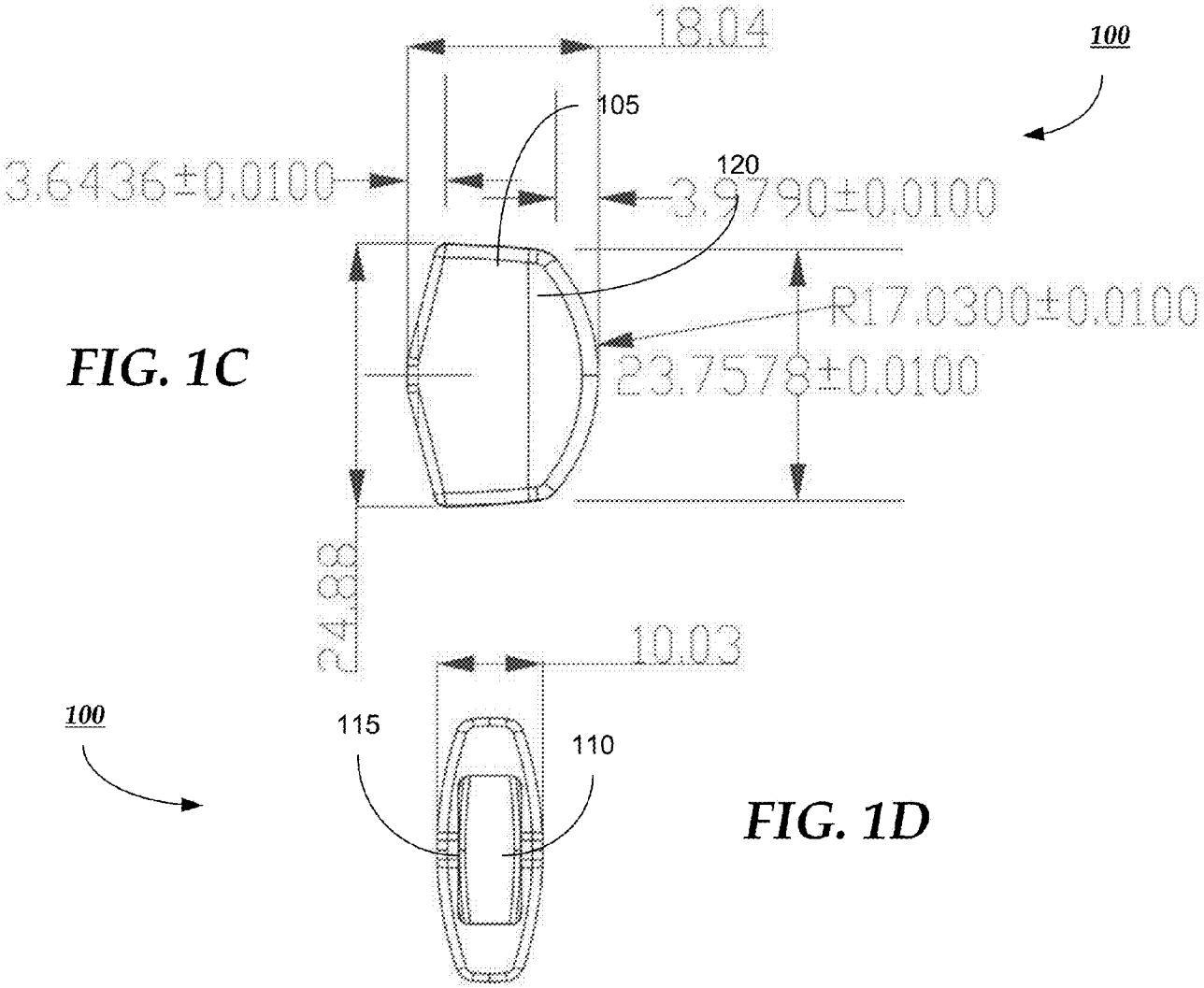
FIG. 1C illustrates a first view of another embodiment of a tuning peg.
FIG. 1D illustrates a second view of the above-referenced embodiment of the tuning peg.
Figure 2:
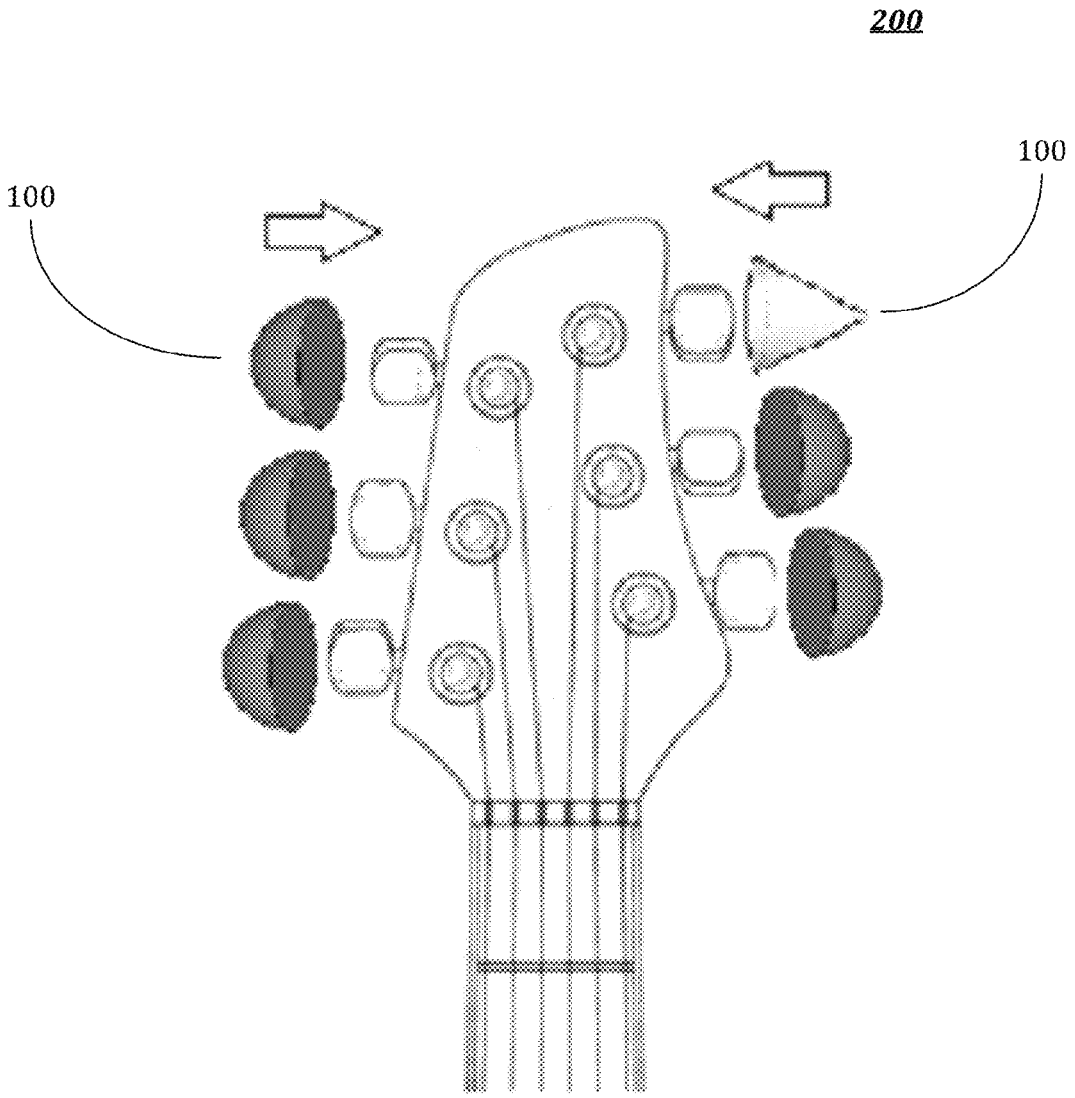
FIG. 2 illustrates tuning peg covers consistent with embodiments of the present invention.

FIGS. 1C-1D illustrate the embodiment of the tuning peg with specified dimensions (may be in mm). It should be understood that the dimensions specified in FIGS. 1C-1D are illustrative, non-limiting examples of a tuning peg cover consistent with embodiments of the present disclosure. Different tuning peg covers may vary in size, shape, and design to accommodate the instruments actual tuning peg.

FIGS. 1A-1D further represent embodiments of the tuning peg cover that may comprise a covering component configured to slide over a tuning peg. Other embodiments of the tuning peg cover may comprise a material configured to be affixed to the tuning peg itself. The tuning peg covers may be configured to cover at least a portion of a tuning peg or the tuning peg in its entirety.

The tuning peg cover may serve a variety of uses. One use of the tuning peg cover may be, for example, to extend the aesthetic value of a string instrument. As will described in greater detail below, the tuning cover may be designed to complement the artistic features of the instrument. In yet further embodiments, the tuning peg cover may be used for promotion. For example, as will be detailed below, the tuning peg cover may be customized to promote a musician, band, or brand of a product or service provider.

Moreover, musicians often desire to have a unique appearance and design to their instrument. By configuring their instrument with tuning peg covers, a musician can easily customize the appearance of his or her instrument. Furthermore, due to the ease in replacing tuning peg covers from the instrument, the musician is enabled to continuously change the custom appearance of their instrument by reconfiguring the instrument with alternate tuning peg cover designs. In this way, tuning peg covers consistent with embodiment of the present disclosure may be utilized to personalize an instrument.

Still consistent with embodiments of the present disclosure, tuning peg covers may be employed as a learning aid for aspiring musicians. For example, a tuning peg cover may be labeled to identify a string corresponding to a tuning peg covered by the tuning peg cover. The aspiring musician, when tuning or playing his or her instrument, may quickly glance at the configured tuning peg covers and quickly discern the strings of the instrument. Accordingly, the tuning peg cover may serve to both personalize an instrument and assist a musician in operating the instrument.

In yet further embodiments of the present invention, the tuning peg covers may also be configured with pick holders. As well known to one of ordinary skill in the art, guitarists often play, or 'pluck', their instrument with picks. During the playing of the guitar, the pick may wear and lose its effectiveness. Further still, guitarists may drop their pick in the course of their performance. Consequently, guitarists are often searching for an easily accessible place to keep spare picks.

Embodiments of the tuning peg covers may be configured with a means to store at least one guitar pick. The means may comprise, for example, but not be limited to, a slit 120 configured in or a pocket attached to the tuning peg cover. In this way, the guitarist may store the picks within the tuning peg covers configured to the instrument.

Embodiments of the present invention may be designed to accommodate a variety of tuning peg shapes and sizes. By way of non-limiting example, tuning peg cover manufacturing may comprise the process of injection molding.

Injection molding is a manufacturing process for producing parts by injecting material into a mold. Injection molding can be performed with a host of materials, including metals, glasses, elastomers, confections, and most commonly thermoplastic and thermosetting polymers. Material for the part may be fed into a heated barrel, mixed, and forced into a mold cavity where it cools and hardens to the configuration of the cavity.

An injection mold may be created for a variety of tuning peg shapes and sizes. The mold may be used to facilitate the consistency of the tuning peg cover manufacturing process. In turn, the consistency may enable the automation and integration of machines into the manufacturing process of the tuning covers.

II. Tuning Peg Customization

Once the tuning peg covers are produced into a particular shape and size, the design process may continue by applying graphics or text to the tuning peg cover. Consistent with embodiments of the present invention, the shape and size of the tuning peg covers, as well as the graphics and text overlaid on the tuning peg covers, may be customized by the musician. To streamline the customization process, the manufacturer may provide musicians with, for example, an online platform for tuning peg cover purchase and customization.

Figure 3:
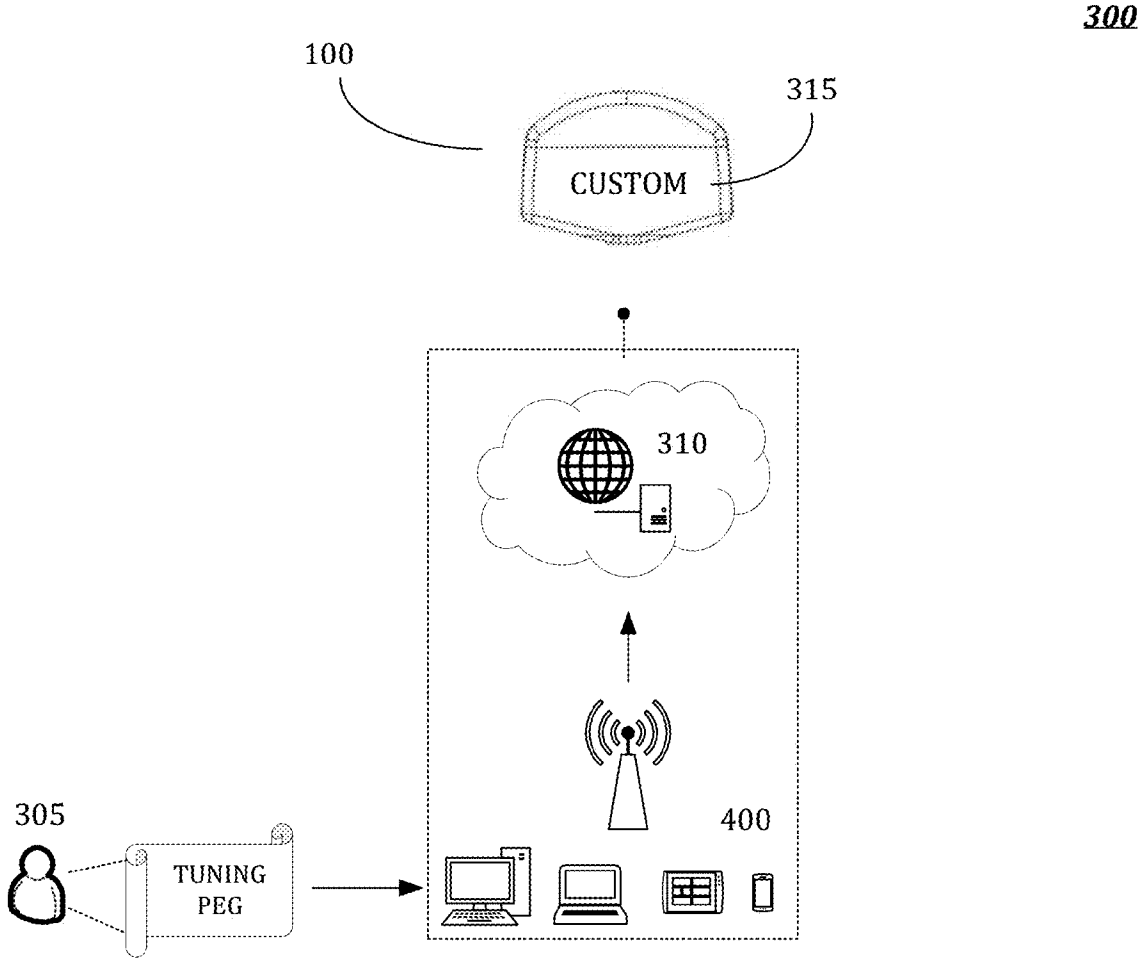
FIG. 3 illustrates an operating environment for providing tuning peg customization.

FIG. 3 illustrates one possible operating environment through which a tuning peg cover purchase and customization platform consistent with embodiments of the present disclosure may be provided. By way of non-limiting example, a platform 300 may be hosted on a centralized server 310, such as, for example, a cloud computing service. A user 305 may access platform 300 through a software application. The software application may be embodied as, for example, but not be limited to, a website, a web application, a desktop application, and a mobile application compatible with a computing device 400. One possible embodiment of the software application may be provided by the Headz™ suite of products and services provided by Bohemian Guitars LLC.

User 305 may access server 310 via an online portal to customize and order tuning peg covers. The portal may comprise a user-interface (UI) enabling a user to select a shape and size of the tuning cover. The user may select from a predetermined set of shapes and sizes provided by the manufacturer. In some embodiments, the UI may enable the user to specify the type of instrument for which tuning peg covers are desired. In turn, the manufacturer may determine the specification for the tuning peg cover based on the selected type of instrument. In yet further embodiments, a customized shape and size may be received from a schematic uploaded by a user.

Once the user customizes the shape and size of the tuning peg covers, the UI may enable the user to overlay graphics and/or text 315 to the tuning peg covers. For example, the user may select from a plurality of predetermined graphics, patterns, logos, and messages that may be overlaid onto the tuning peg covers. In yet further embodiments, the user may upload an image or text desired to be overlaid on the tuning peg covers.

Having received the design specifications for the tuning peg covers, the manufacturer is then able to produce and package the tuning peg covers to a musician's liking. The tuning peg covers may be packaged in sets corresponding to a quantity of strings for a particular instruments. For example, the tuning peg covers may be sold in sets of four, six, seven, and twelve.

Still consistent with embodiments of the present invention, each package of tuning peg covers may accompany labels. The labels may be customized by the user during, for example, the aforementioned online customization process. In some embodiments, the labels may comprise an indicator for the pitch of a corresponding string. In this way, the labels may be used as a learning aid, helping a novice musician learn the strings of the instrument.

The platform 300 may be embodied as, for example, but not be limited to, a website, a web application, a desktop application, and a mobile application compatible with a computing device. The computing device may comprise, but not be limited to, a desktop computer, laptop, a tablet, or mobile telecommunications device. Moreover, platform 300 may be hosted on a centralized server, such as, for example, a cloud computing service.

Embodiments of the present disclosure may comprise a system having a memory storage and a processing unit. The processing unit coupled to the memory storage, wherein the processing unit is configured to perform the above mentioned processes and configurations.

Figure 4:
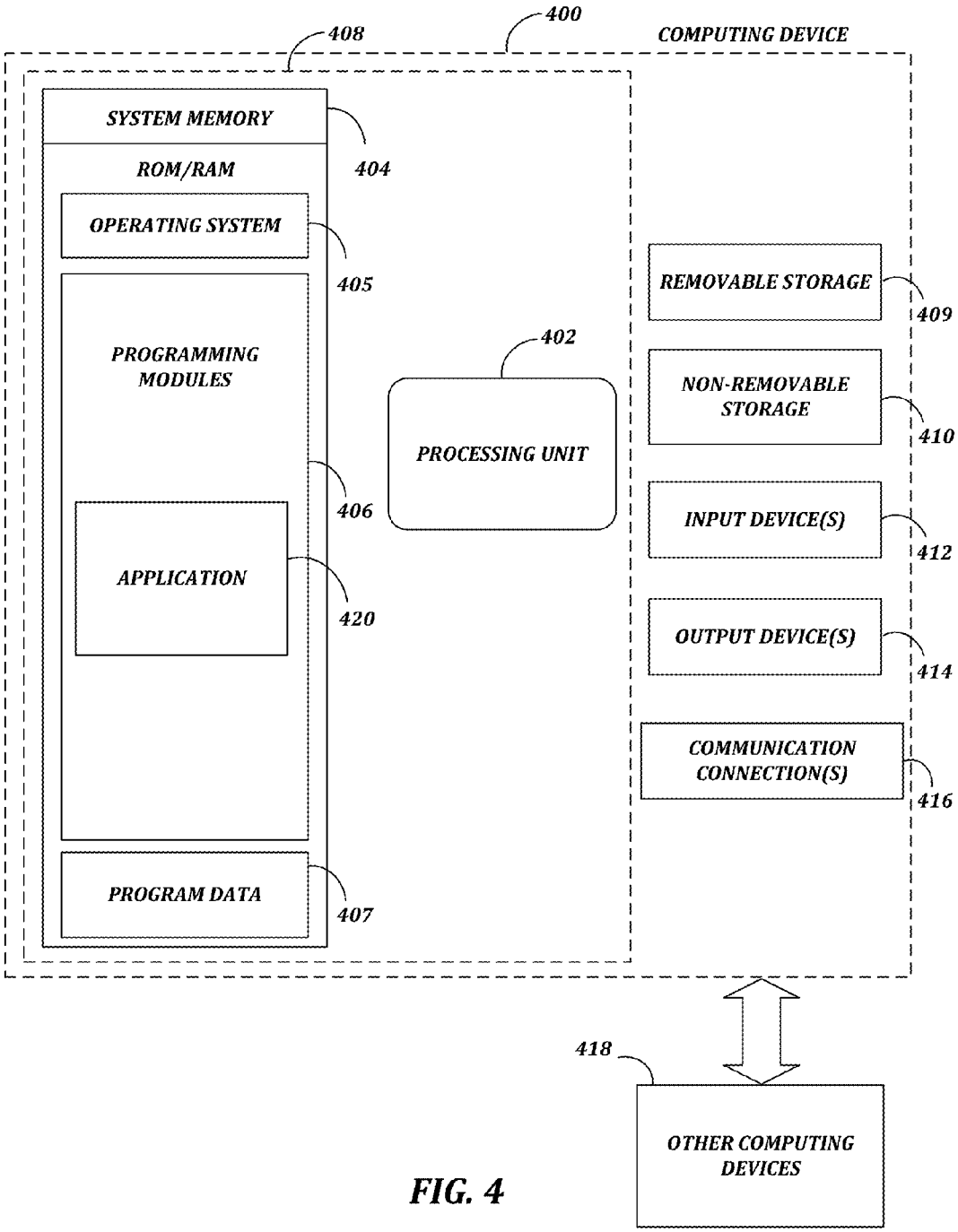
FIG. 4 is a block diagram of a system including a computing device for providing tuning peg customization.

FIG. 4 is a block diagram of a system including computing device 400. Consistent with an embodiment of the disclosure, the aforementioned memory storage and processing unit may be implemented in a computing device, such as computing device 400 of FIG. 4. Any suitable combination of hardware, software, or firmware may be used to implement the memory storage and processing unit. For example, the memory storage and processing unit may be implemented with computing device 400 or any of other computing devices 418, in combination with computing device 400. The aforementioned system, device, and processors are examples and other systems, devices, and processors may comprise the aforementioned memory storage and processing unit, consistent with embodiments of the disclosure.

With reference to FIG. 4, a system consistent with an embodiment of the disclosure may include a computing device, such as computing device 400. In a basic configuration, computing device 400 may include at least one processing unit 402 and a system memory 404. Depending on the configuration and type of computing device, system memory 404 may comprise, but is not limited to, volatile (e.g. random access memory (RAM)), non-volatile (e.g. read-only memory (ROM)), flash memory, or any combination. System memory 404 may include operating system 405, one or more programming modules 406, and may include a program data 407. Operating system 405, for example, may be suitable for controlling computing device 400's operation. In one embodiment, programming modules 406 may include purchase and customization application 420. Furthermore, embodiments of the disclosure may be practiced in conjunction with a graphics library, other operating systems, or any other application program and is not limited to any particular application or system. This basic configuration is illustrated in FIG. 4 by those components within a dashed line 408.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer readable instructions, data structures, program modules, or other data. System memory 404, removable storage 409, and non-removable storage 410 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 such as a keyboard, a mouse, a pen, a sound input device, a touch input device, etc. Output device(s) 414 such as a display, speakers, a printer, etc. may also be included. The aforementioned devices are examples and others may be used.

Computing device 400 may also contain a communication connection 416 that may allow device 400 to communicate with other computing devices 418, such as over a network in a distributed computing environment, for example, an intranet or the Internet. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 404, including operating system 405. While executing on processing unit 402, programming modules 406 (e.g., purchase and customization application 420) may perform processes including, for example, one or more of the processes and configurations as described above. The aforementioned process is an example, and processing unit 402 may perform other processes. Other programming modules that may be used in accordance with embodiments of the present disclosure may include electronic mail and contacts applications, word processing applications, spreadsheet applications, database applications, slide presentation applications, drawing or computer-aided application programs, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

All rights including copyrights in the code included herein are vested in and the property of the Applicant. The Applicant retains and reserves all rights in the code included herein, and grants permission to reproduce the material only in connection with reproduction of the granted patent and for no other purpose.

V. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

We claim:

1. A tuning peg cover comprising:
an interior portion designed to accommodate a tuning peg of a stringed instrument;
an exterior shell encompassing the interior portion;
a slit configured to hold a instrument pick; and
a slot configured to receive the tuning peg into the interior portion.

2. The tuning peg cover of claim 1, wherein a design of the exterior shell is customizable.

3. The tuning peg cover of claim 1, wherein the exterior shell is configured to be overlaid with a layer of material.

4. The tuning peg cover of claim 3, wherein the layer of material is customizable.

5. The tuning peg cover of claim 1, wherein the exterior shell is comprises a label associated with a string tied to the tuning peg of the stringed instrument.

6. The tuning peg cover of claim 3, wherein the layer of material comprises the label.

7. The tuning peg cover of claim 1, wherein the exterior shell is comprises a design associated with a musician or group of musicians.

8. The tuning peg cover of claim 3, wherein the layer of material comprises the design.

9. The tuning peg cover of claim 1, wherein the exterior shell is branded.

10. The tuning peg cover of claim 3, wherein the layer of material comprises the brand.

* * * * *